United States Patent [19]

Otani et al.

[11] Patent Number: 4,492,209

[45] Date of Patent: Jan. 8, 1985

[54] EXHAUST GAS RECIRCULATION SYSTEM

[75] Inventors: Junji Otani, Oomiya; Yasuo Ikenoya, Kawagoe; Masafumi Araki, Asaka, all of Japan

[73] Assignee: Honda Giken Kogyo Kabushiki Kaisha, Tokyo, Japan

[21] Appl. No.: 386,209

[22] Filed: Jun. 7, 1982

[30] Foreign Application Priority Data

Jun. 5, 1981 [JP] Japan ..... 56-86608
Jul. 3, 1981 [JP] Japan ..... 56-104238

[51] Int. Cl.[3] ..... F02M 25/06
[52] U.S. Cl. ..... 123/568; 123/571
[58] Field of Search ..... 123/568, 569, 571, 570

[56] References Cited

U.S. PATENT DOCUMENTS

| | | | |
|---|---|---|---|
| 2,543,194 | 2/1951 | Paris, Jr. | 123/570 |
| 2,722,927 | 11/1955 | Cornelius | 123/568 |
| 3,738,342 | 6/1973 | Lewakowski | 123/568 |
| 3,842,814 | 10/1974 | Bier | 123/568 |
| 4,080,941 | 3/1978 | Bertrand | 123/568 |
| 4,094,287 | 6/1978 | Nohira | 123/568 |
| 4,144,856 | 3/1979 | Tsukamoto et al. | 123/568 |
| 4,304,210 | 12/1981 | Hayakawa | 123/568 |

*Primary Examiner*—Wendell E. Burns

*Attorney, Agent, or Firm*—Armstrong, Nikaido, Marmelstein & Kubovcik

[57] ABSTRACT

Herein disclosed is an exhaust gas recirculation system for an internal combustion engine, in which system communication is provided between an exhaust passage and an intake passage by way of an exhaust gas recirculation passage so that the exhaust gas in the exhaust passage is partially recirculated into the intake passage by the intake vacuum prevailing in the intake passage. The exhaust gas recirculation system is constructed to include: a vacuum-operated type exhaust gas recirculation valve disposed midway of the exhaust gas recirculation passage for regulating and controlling the flow rate of the exhaust gas to flow in said exhaust gas recirculation passage; a vacuum supply passage for providing communication of a vacuum chamber of the exhaust gas recirculation valve with the intake passage downstream of a throttle valve; a vacuum control valve connected with the vacuum supply passage for controlling the vacuum force of intake air to flow in the vacuum supply passage; and an interlocking mechanism for interlocking the vacuum control valve and the throttle valve. As a result, the exhaust gas recirculation control can be properly conducted, and a rider is enabled to do his throttling operation smoothly and lightly.

3 Claims, 8 Drawing Figures

EXHAUST GAS RECIRCULATION SYSTEM

BACKGROUND OF THE INVENTION

1. Field of the Invention

The present invention relates to an internal combustion engine and, more particularly, to an exhaust gas recirculation system (EGR) for use with the internal combustion engine, in which an engine exhaust gas is partially recirculated into intake air to suppress excessive rise in the combustion temperature so that the emission of nitrogen oxides $NO_x$ can be reduced as much as possible.

2. Description of the Prior Art

In the aforementioned exhaust gas recirculation system, there is known to the prior art technical means by which the exhaust gas is recirculated at a flow rate proportional to the intake air flow rate into the intake air with a view to minimizing the emission of unburned noxious contents in the exhaust gas such as hydrocarbons HC or carbon monoxide CO and to effectively reducing the emission of the nitrogen oxides $NO_x$. As the technical means thus known, there have been proposed the following three systems:

(1) Exhaust Back Pressure Control System;

(2) Load Proportioning System; and (3) Throttle Valve Coacting System.

The system (1) notices the fact that the exhaust back pressure has a correlation with the flow rate of the intake air into the internal combustion engine, and controls the EGR vacuum by the back pressure. According to this system, if it is intended to effect a precise exhaust recirculation when in a low-load running operation of the engine, the exhaust back pressure has to be raised by throttling or reducing the diameter of an exhaust duct. However, if the exhaust duct is throttled while the internal combustion engine is run at a high speed, there arises a disadvantage that the exhaust resistance is increased so that a desired high-speed output cannot be generated.

On the other hand, the second system (2) makes use of the relationship between the intake air flow rate of the internal combustion engine and the venturi vacuum of a fixed venturi type carburetor. This invites a disadvantage that the system (2) cannot be applied to the engine which is equipped with such a variable venturi type carburetor as has its venturi vacuum varied even for an identical intake air flow rate if the effective area of the venturi is varied.

On the other hand, the third system (3) makes the throttle valve of a carburetor and an exhaust gas recirculation valve coactive and is known as a relatively reliable system. However, since the exhaust gas recirculation valve requiring a high operating force is connected to the throttle valve of a carburetor, the operations of opening and closing the throttle valve is dragged to exert more or less excessive load upon the throttling operation of a rider thereby to invite a disadvantage that the fatigue of the rider is increased after a long ride.

SUMMARY OF THE INVENTION

It is, therefore, a major object of the present invention to provide an exhaust gas recirculation system for use with an internal combustion engine, which is enabled to ensure the exhaust gas recirculation according to the foregoing third system (3) and to allow a rider to do his throttling operation smoothly and lightly.

Another object of the present invention is to provide an exhaust gas recirculation system for an internal combustion engine of the aforementioned kind, which has none of its parts exposed or protruding to the outside thereby to avoid interference with obstacles or the like and to invite no trouble in the assembly and maintenance of other existing devices and which has such a simple construction that it can be produced at a low cost.

In order to achieve the above-identified objects, according to a feature of the present invention, there is provided an exhaust gas recirculation system for an internal combustion engine, which system comprises: an exhaust pick-up port communicating with an exhaust passage; an exhaust gas recirculation port communicating with an intake passage; and an exhaust gas recirculation passage providing communication between said exhaust pick-up port and said exhaust gas recirculation port so that the exhaust gas in said exhaust passage may be partially recirculated into said intake passage by the intake pressure prevailing in said intake passage, wherein the improvement comprises: a vacuum-operated type exhaust gas recirculation valve disposed midway of said exhaust gas recirculation passage for regulating and controlling the flow rate of the exhaust gas to flow in said exhaust gas recirculation passage; a vacuum supply passage for providing communication of a vacuum chamber of said exhaust gas recirculation valve with said intake passage downstream of a throttle valve; a vacuum control valve connected with said vacuum supply passage for controlling the vacuum force of intake air to flow in said vacuum supply passage; and an interlocking mechanism for interlocking said vacuum control valve and said throttle valve.

In the exhaust gas recirculation system of the aforementioned type, according to another feature of the present invention, said vacuum control valve includes: a valve housing; a diaphragm partitioning the inside of said valve housing into a vacuum chamber communicating with said vacuum supply passage and an atmospheric chamber vented to the atmosphere; a valve seat formed on said diaphragm and formed with a valve opening for providing communication between said vacuum chamber and said atmospheric chamber; a valve body adapted to be brought into and out of contact with said valve seat and made coactive with said valve seat for forming a variable orifice; and a diaphragm spring for biasing said diaphragm so that said valve seat may approach said valve body.

In an exhaust gas recirculation system of the type thus far described, according to a further feature of the present invention, said interlocking mechanism includes a control member made coactive with said valve body and made responsive to the opening and closing operations of said throttle valve for moving said valve body up and down.

In an exhaust gas recirculation system of the type thus far described, according to a further feature of the present invention, said exhaust pick-up port and said exhaust gas recirculation port are formed in the cylinder head of an engine, and said exhaust gas recirculation passage is formed in a head cover crowning said cylinder head.

The above and other objects, features and advantages of the present invention will become apparent from the following detailed description of a preferred embodiment when taken in conjunction with the accompanying drawings.

BRIEF DESCRIPTION OF THE DRAWINGS

In the accompanying drawings showing one embodiment of the present invention.

DESCRIPTION OF THE PREFERRED EMBODIMENT

The present invention will be described in the following with reference to the accompanying drawings in connection with one embodiment, in which it is applied to an internal combustion engine for a motorcycle. A series two-cylinder internal combustion engine E is transversely mounted on the frame F of a motorcycle.

Figure 1:
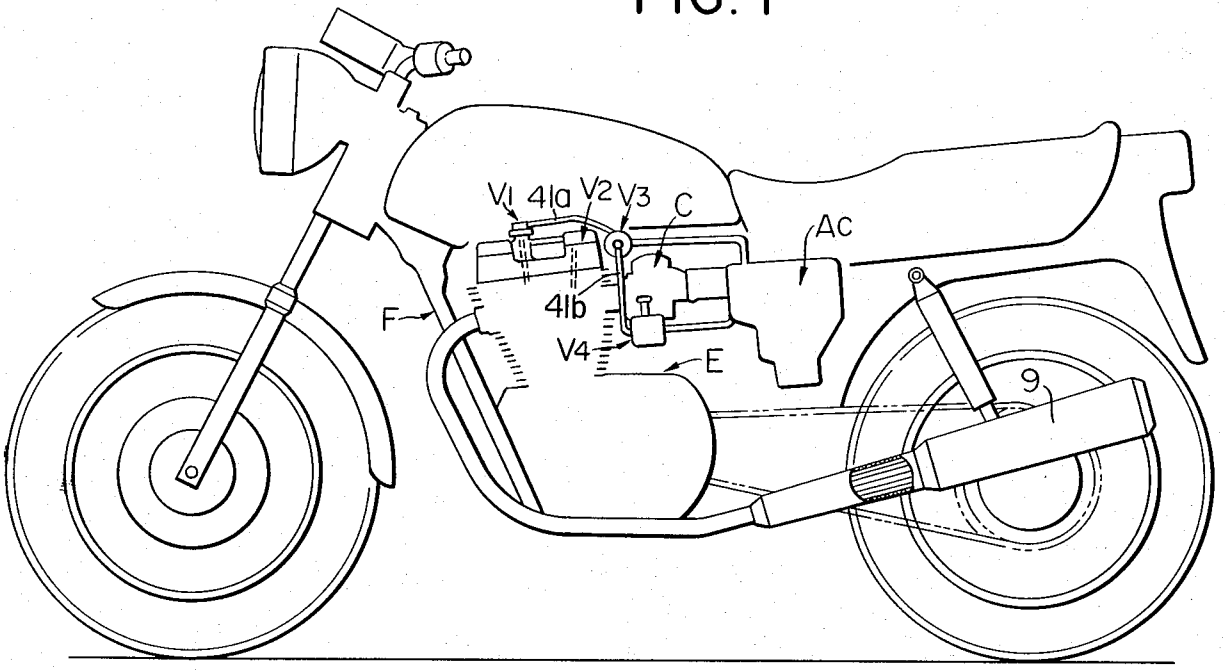
FIG. 1 is a side elevation showing a motorcycle which is equipped with an exhaust gas recirculation system according to the present invention.
Figure 2:
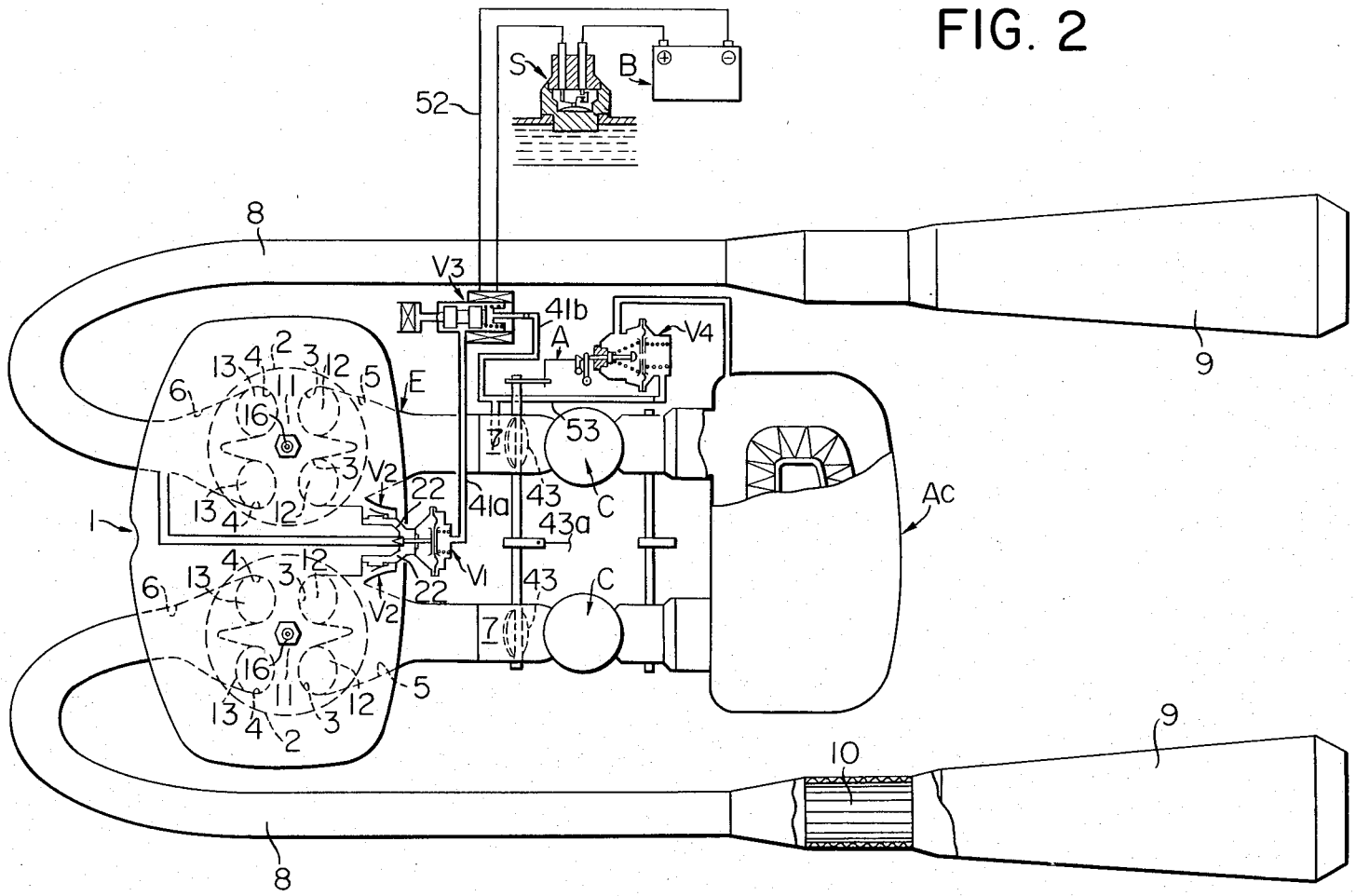
FIG. 2 is a schematic top plan view of the same.
Figure 3:
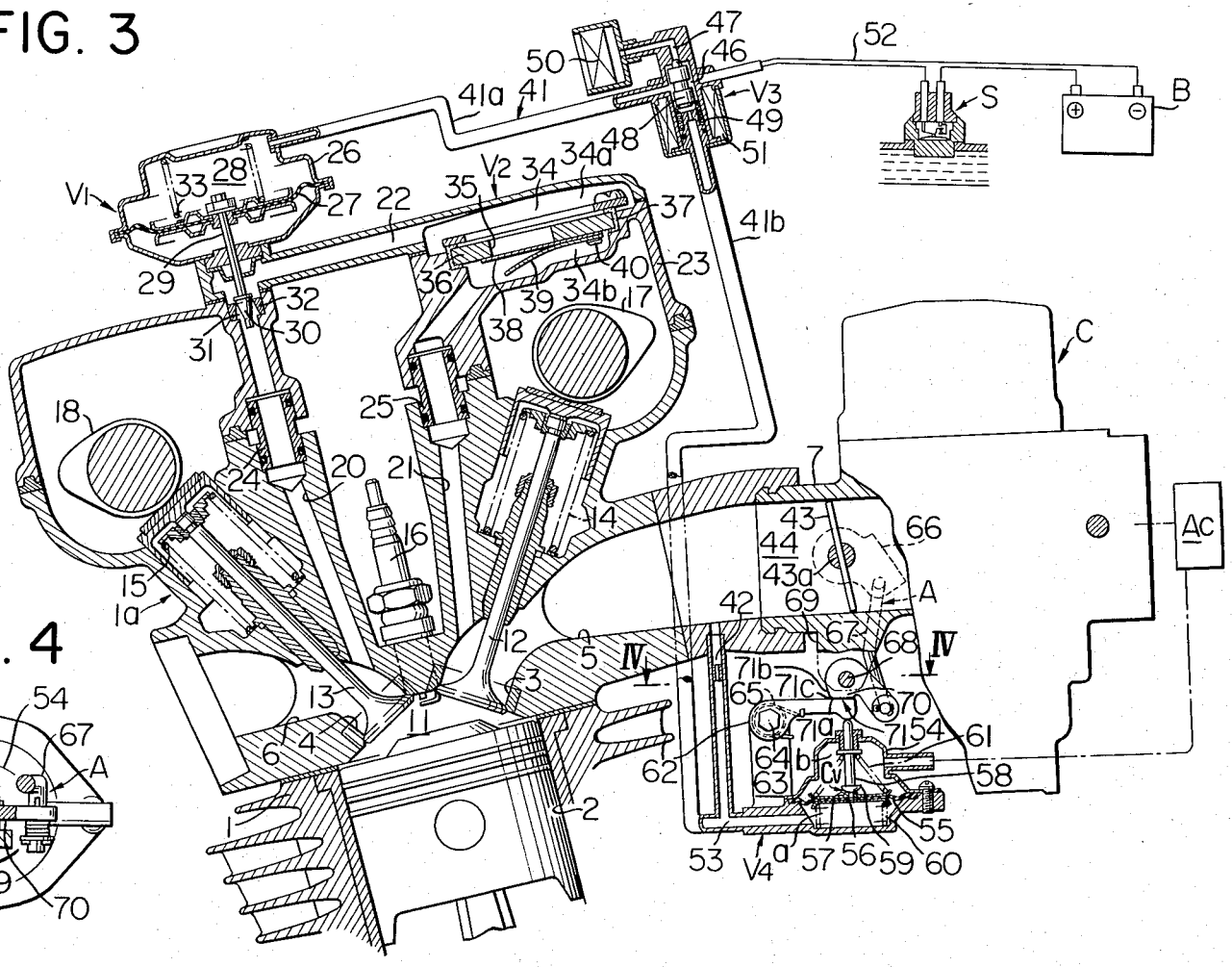
FIG. 3 is a longitudinally sectional side elevation showing the system of the present invention.
Figure 4:
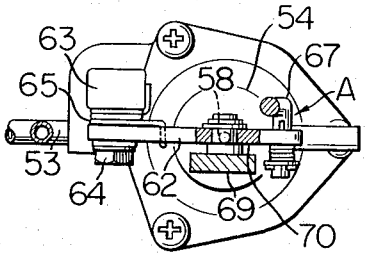
FIG. 4 is a section showing a portion taken along line IV—IV.

Referring now to FIGS. 2 and 3, combustion chambers 11 defined above the cylinders 2 and 2 of an engine body 1 are formed with intake valve openings 3 and 3 and exhaust valve openings 4 and 4. A bifurcated intake port 5 communicating with the intake valve openings 3 and 3 is opened in the rear wall of the engine body 1, whereas a bifurcated exhaust port 6 communicating with the exhaust valve openings 4 and 4 is opened in the front wall of the engine body 1. Carburetors C and C are disposed midway of intake ducts 7 and 7 which lead to the intake ports 5 and 5 of the respective cylinders 2 and 2. An air cleaner Ac is connected in a riding manner with the end portions of those intake ducts 7 and 7. On the other hand, exhaust ducts 8 and 8 leading to the exhaust ports 6 and 6 of the respective cylinders 2 and 2 are extended along both the sides of the engine body 1 to the back of the same. To the rear ends of the respective exhaust ducts 8, there are connected exhaust mufflers 9 by catalytic converters 10.

In the cylinder head 1*a* of the engine body 1, there are disposed intake valves 12 and exhaust valves 13 which are made operative to open and close the intake valve openings 3 and the exhaust valve openings 4 and which are actuated as usual by valve springs 14 and 15 and valve-operating cams 17 and 18. On the other hand, the combustion chambers 11 are equipped with spark plugs 16 which are interposed between the intake and exhaust valves 12 and 12, and 13 and 13.

The aforementioned engine body 1 is equipped with an exhaust gas recirculation system (EGR) for recirculating a portion of an engine exhaust gas into an intake passage. The construction of this system will be described in the following. As shown in FIG. 3, the cylinder head 1*a* is formed with an exhaust pick-up port 20 and an exhaust gas recirculation port 21. The exhaust pick-up port 20 has its lower end communicating with the vicinity of the exhaust valve 13 of either of the two exhaust ports 6 and 6 of the respective cylinders 2 and its upper end opened in the upper wall of the cylinder head 1*a*. On the other hand, the exhaust gas recirculation port 21 has its lower end communicating with the vicinity of the intake valve 12 of either of the two intake ports 5 and 5 of the respective cylinders 2 in the tangential direction of the corresponding port. Thus, as will be described hereinafter, an vortex flow is established at a suction stroke in the engine exhaust gas which is to be fed to the intake port 5 by way of the exhaust gas recirculation port 21. As a result, a burned gas can be much accumulated at a place apart from the spark plug 16 so that the ignition by the spark plug 16 is ensured to enhance the combustion efficiency and to reduce the emission of unburned contents such as HC thereby to minimize the deterioration of the drivability.

The cylinder head 1*a* is crowned with a head cover 23 which is formed with an exhaust gas recirculation passage 22 at a thicker portion of its upper wall. This exhaust gas recirculation passage 22 has both its ends opened in the lower wall of the head cover 23 and connected through connecting tubes 24 and 25 with the aforementioned exhaust pick-up port 20 and exhaust gas recirculation port 21. Between the connecting tubes 24 and 25 and the cylinder head 1*a* and between the connecting tubes 24 and 25 and the head cover 23, there are sandwiched O-rings for maintaining gas-tightnesses.

Midway of the aforementioned exhaust gas recirculation passage 22, there is disposed a later-described exhaust gas recirculation valve $V_1$ which is disposed above the head cover 23. In the exhaust gas recirculation passage 22 downstream of said valve $V_1$, moreover, there is disposed a check valve $V_2$ which is made operative, although detailed hereinafter, to allow the exhaust gas to flow from that exhaust gas recirculation passage 22 to the exhaust gas recirculation port 21.

Next, the specific construction of the above exhaust gas recirculation valve $V_1$ will be described in the following. This recirculation valve $V_1$ is constructed of such a vacuum-operated type that a valve housing 26 is fixedly overlaid on the aforementioned head cover 23 and that a diaphragm 27 is disposed under tension in that valve housing 26 thereby to partition the inside into a vacuum chamber 28 and an atmospheric chamber at both the sides thereof. To the center portion of the aforementioned diaphragm 27, there is fixed a valve rod 29 having a lower end, to which a cone valve 30 is fixed. This cone valve 30 is inserted into the valve opening 31 of a valve seat member 32, which is formed in the exhaust gas recirculation passage 22 so that the aforementioned valve opening 31 can have its effective area variably adjusted by the vertical movements of the cone valve 30 and can be closed. In the aforementioned vacuum chamber 28, there is disposed a diaphragm spring 33 which has its elastic force acting to push downward the cone valve 30.

Next, the construction of the check valve $V_2$ will be described in the following. This check valve $V_2$ is constructed of a reed valve which is to be opened by the intake vacuum prevailing in the intake port 5 and which is disposed in each cylinder 2, as shown in FIG. 2. In the upper portion of the head cover 23, there is formed a valve chamber 34 which has communication with the aforementioned exhaust gas recirculation passage 22 and in which there is fixed through a heat-resistant elastic packing 37 a valve seat member 36 having a valve opening 35. The inside of the valve chamber 34 is partitioned by that valve seat member 36 into an upstream chamber 34*a* and a downstream chamber 34*b*. The upstream chamber 34*a* is made common between the two check valves $V_2$ of the respective cylinders 2 while having a large capacity, whereas the downstream chamber 34*b* is made independent for each cylinder 2. On the lower wall of the valve seat member 36, there are overlapped a reed 38, which is made operative to open and close the valve opening 35, and a reed stopper 39 which is made operative to restrict the opening of that reed 38. The reed 38 and the reed stopper 39 thus made have their base ends fastened to the valve seat member 36 by means of a set screw 40. When the reed 38 is opened by the intake vacuum which is built up in the intake port 5 at a suction stroke, the exhaust gas having flown from the exhaust port 6 via the exhaust pick-up port 20 into the exhaust gas recirculation passage 22 further flows through that check valve $V_2$ into the exhaust gas recirculation port 21, from which it is introduced into the intake port 5.

Now, since the aforementioned valve seat member 36 is supported through the heat-resistant packing 37 in the valve chamber 34, the knocking sounds, which might otherwise be generated when the reed 38 hits the valve seat member 36 after it has been opened, can be eliminated. Moreover, since the aforementioned upstream chamber 34*a* is formed into a single but large chamber made common for the two check valves $V_2$ of the respective cylinders 2, the pulsations therein can be lessened to reduce the resistance so that a desired amount of the exhaust gas can be fed to the intake port 5 and so that the height of the upstream chamber 34*a* can be reduced while retaining the necessary capacity of the upstream chamber 34*a*. Furthermore, since the downstream chambers 34*b* of the two check valves $V_2$ of the respective cylinders 2 are made independent of each other, the downstream chamber 34*b* of the check valve $V_2$ corresponding to one cylinder 2 is not influenced by the pressure change from the other cylinder 2 having a different explosion order. As a result, the check valves $V_2$ can be operated respectively properly without having run short of the flow rate of the exhaust gas into the intake port 5.

With the vacuum chamber 28 of the aforementioned exhaust gas recirculation valve $V_1$, there communicates a vacuum supply passage 41, midway of which such an electromagnetic change-over valve $V_3$ is interposed as will be detailed hereinafter. This valve $V_3$ is made operative to switch the communication of the vacuum chamber 28 with an intake passage 44 or the atmosphere.

The vacuum supply passage 41 has its end portion communicating through a fixed orifice 42 with the intake passage downstream of the throttle valve 43 of the aforementioned carburetor C so that the intake vacuum in said intake passage 44 is supplied by way of the vacuum supply passage 41 and the aforementioned electromagnetic change-over valve $V_3$ to the vacuum chamber 28 of the aforementioned exhaust gas recirculation valve $V_1$.

Next, the construction of the aforementioned electromagnetic change-over valve $V_3$ will be described in the following. This valve $V_3$ is disposed midway of the vacuum supply passage 41 to switch the communication of the aforementioned vacuum chamber 28 with the aforementioned intake passage 44 or the atmosphere. In a valve chamber 46 of the electromagnetic changeover valve $V_3$, there are opened a downstream vacuum supply passage 41*a* communicating with the aforementioned vacuum chamber 28, an upstream vacuum supply passage 41*b* communicating with the intake passage 44, and a lead passage 47 vented to the asmosphere. In the valve chamber 46, moreover, there is fitted a valve body 48 which is made operative to selectively open and close the open ends of the aforementioned upstream vacuum supply passage 41*b* and leak passage 47. The valve body 48 is so biased by the elastic force of a valve spring 49 as to close the leak passage 47. In the valve chamber 46, moreover, there is disposed a solenoid 51 which is made operative to actuate the aforementioned valve body 48. When that solenoid 51 is energized, the valve body 48 is attracted downward against the elastic force of the valve spring 49 thereby to close the aforementioned upstream vacuum supply passage 41*b*. The aforementioned solenoid 51 is connected with a power circuit 52 which in turn is connected with a battery B. Midway of that power circuit 52, there is disposed a thermo-switch S which is adapted to sense the temperature of the lubricant of the internal combustion engine such that it is turned on, when the lubricant temperature sensed is lower than a predetermined level, to operate the electromagnetic change-over valve $V_3$ thereby to establish the communication of the aforementioned vacuum chamber 28 with the atmosphere.

From the vicinity of the communicating portion of the upstream vaccuum supply passage 41*b* with the intake passage 44, there is branched another leak passage 53 which is vented to the atmosphere. A vacuum control valve $V_4$ is disposed midway of that leak passage 53.

Next, the construction of that vacuum control valve $V_4$ will be described in the following. A valve housing 54 is disposed midway of the leak passage 53. In that valve housing 54, there is disposed under tension a diaphragm 55, by which the inside of the valve housing 54 is partitioned into a vacuum chamber a communicating with the vacuum supply passage 41 and an atmospheric chamber b vented to the atmosphere. At the center portion of the diaphragm 55, there is disposed a valve seat 57 which is formed with a valve opening 56 between those chambers a and b. In the atmospheric chamber b, there is disposed in a vertically movable manner a valve rod 58 which has its lower portion formed into a semispherical valve body 59. This valve body 59 coacts with the valve seat 57 to form a variable orifice Cv. In the aforementioned vacuum chamber a, there is disposed a diaphragm spring 60 which is interposed under compression between the bottom wall of the valve housing 54 and the diaphragm 55 and which has its elastic force acting to shift the diaphragm 55 upward, i.e., toward the atmospheric chamber b. In the atmospheric chamber b, however, there is disposed a valve spring 61 which is interposed between the diaphragm 55 and the valve rod 58 and which has its elastic force bearing the valve body 59 on the diaphragm 55 in a vertically movable manner. The aforementioned valve rod 58 has its upper end protruding to the outside from the upper wall of the valve housing 54 thereby to form a protruding end, against which the free end of a control stay 62 is made to abut. The aforementioned control stay 62 has its base end hinged at 64 in a vertically rocking manner to a bracket 63 which is erected at one side of the valve housing 54. On the hinged portion 64, there is mounted a return spring 65 which engages with the bracket 63 and the control stay 62 and which has its elastic force acting to bias the control stay 62 to rock upward (i.e., counter-clockwise, as viewed in FIG. 3). The aforementioned control stay 62 is made coactive as a component of an interlocking mechanism A with the valve shaft 43*a* of the throttle valve 43 of the carburetor C. To that valve shaft 43*a*, more specifically, there is fixed a drive stay 66 having a free end portion, to which the upper end of a rod 67 is connected. The lower end of this rod 67 is connected to the free end of a cam member 70 which is hinged at 68 in a vertically rocking manner to a bracket 69 integrated with the carburetor C. The aforementioned cam member 70 constitute together with the control stay 62 a control member of the interlocking mechanism A and is formed with a cam face 71 which is in abutment contact with the free end of the aforementioned control stay 62. That cam face 71 is divided into a first lower cam surface 71*a*, a second lower cam surface 71*b* and an upper cam surface 71*c* which extends between those lower cam surfaces 71*a* and 71*b*. The upper cam surface 71*c* is so shaped as to effect a continuous displacement x of the valve rod 58 in a vertical direction through the control stay 62, as will be described hereinafter.

Next, the operation of the embodiment of the present invention will be described in the following. Now, when the internal combustion engine E is run, the exhaust gas in the exhaust port 6 is partially introduced by the intake vacuum built up in the intake port 5 by way of the exhaust gas recirculation valve $V_1$, the exhaust gas recirculation passage 22, the check valve $V_2$ and the exhaust gas recirculation port 21 into that intake port 5 and is mixed with an air-fuel mixture flowing in said intake port 5 until it is sucked into the combustion chamber 11, thus effecting the so-called "exhaust gas recirculation (EGR)". Here, the exhaust gas recirculation valve $V_1$ operates to block or regulate the flow of the exhaust fas to be fed to the intake port 5 in accordance with the running state of the internal combustion engine E. This control will be described in the following in accordance with the running modes of the internal combustion engine E.

Figure 5:
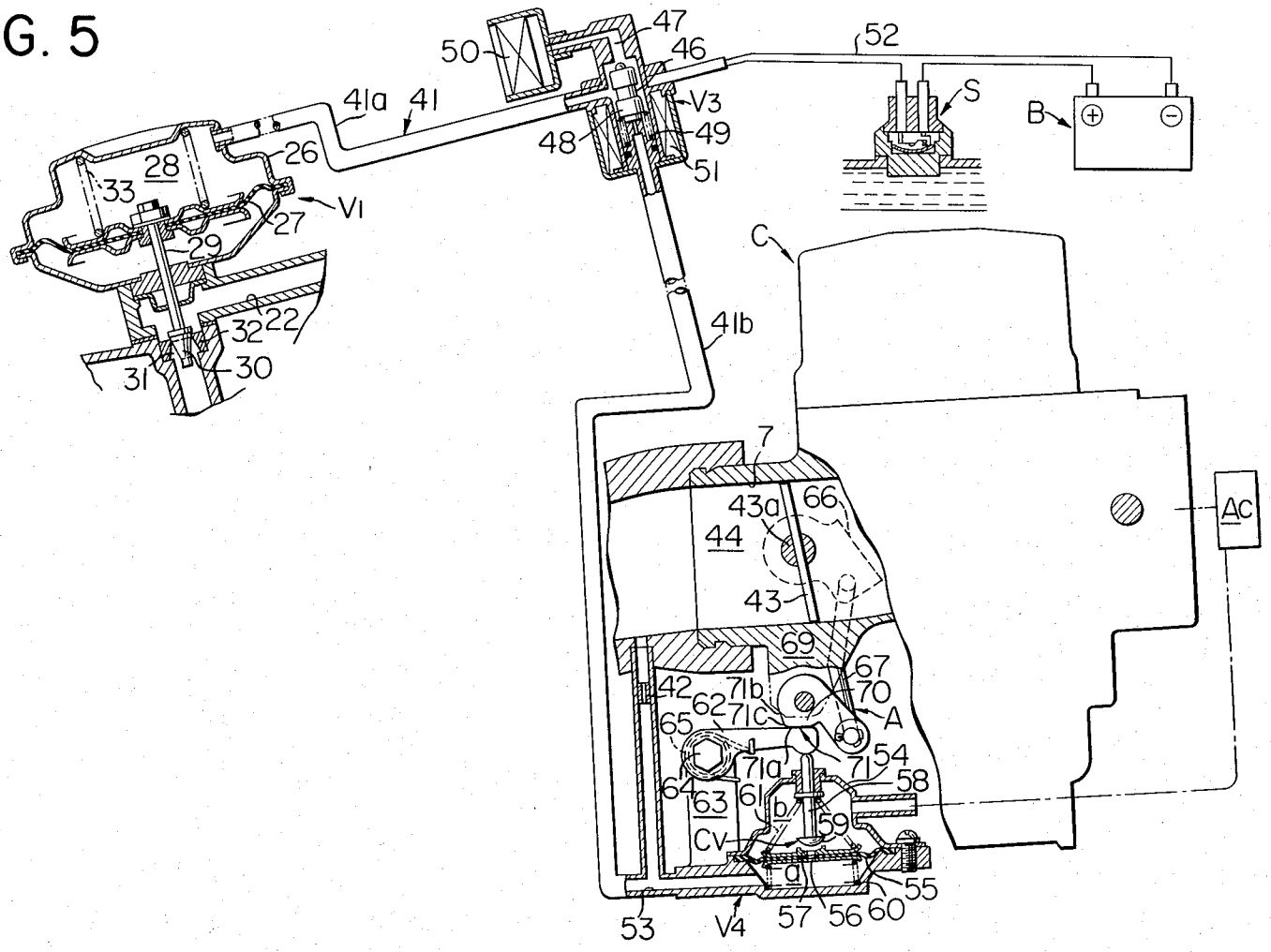
FIG. 5 is a view showing a portion of FIG. 3 when in a cold running operation of an internal combustion engine.

[1] Cold Running Mode of Engine (FIG. 5)

When the engine body 1 is not warmed up yet, as immediately after the start of the engine E, the combustion temperature of the engine E is still low and the nitrogen oxides $NO_x$ are less emitted. Therefore, no exhaust gas recirculation to the intake system is conducted so that the drivability may not be deteriorated. More specifically, since the oil chamber is still at a temperature lower than a predetermined level when in the cold running mode of the engine E, the thermo-switch S is at its "ON" state to energize the solenoid 51 of the electromagnetic change-over valve $V_3$ so that the valve body 48 is attracted downward to establish the communication of the lead passage 47 vented to the atmosphere with the downstream vacuum supply passage 41*a* thereby to establish the communication of the vacuum chamber 28 of the exhaust gas recirculation valve $V_1$ with the atmosphere. Then, the diaphragm 27 is shifted downward by the elastic force of the diaphragm spring 33 so that the cone valve 30 is seated on the valve seat member 32 while leaving the exhaust gas recirculation valve $V_1$ closed. As a result, the exhaust gas in the exhaust port 6 does not flow into the exhaust gas recirculation passage 22 so that no exhaust gas recirculation to the intake port 5 is effected.

Figure 6:
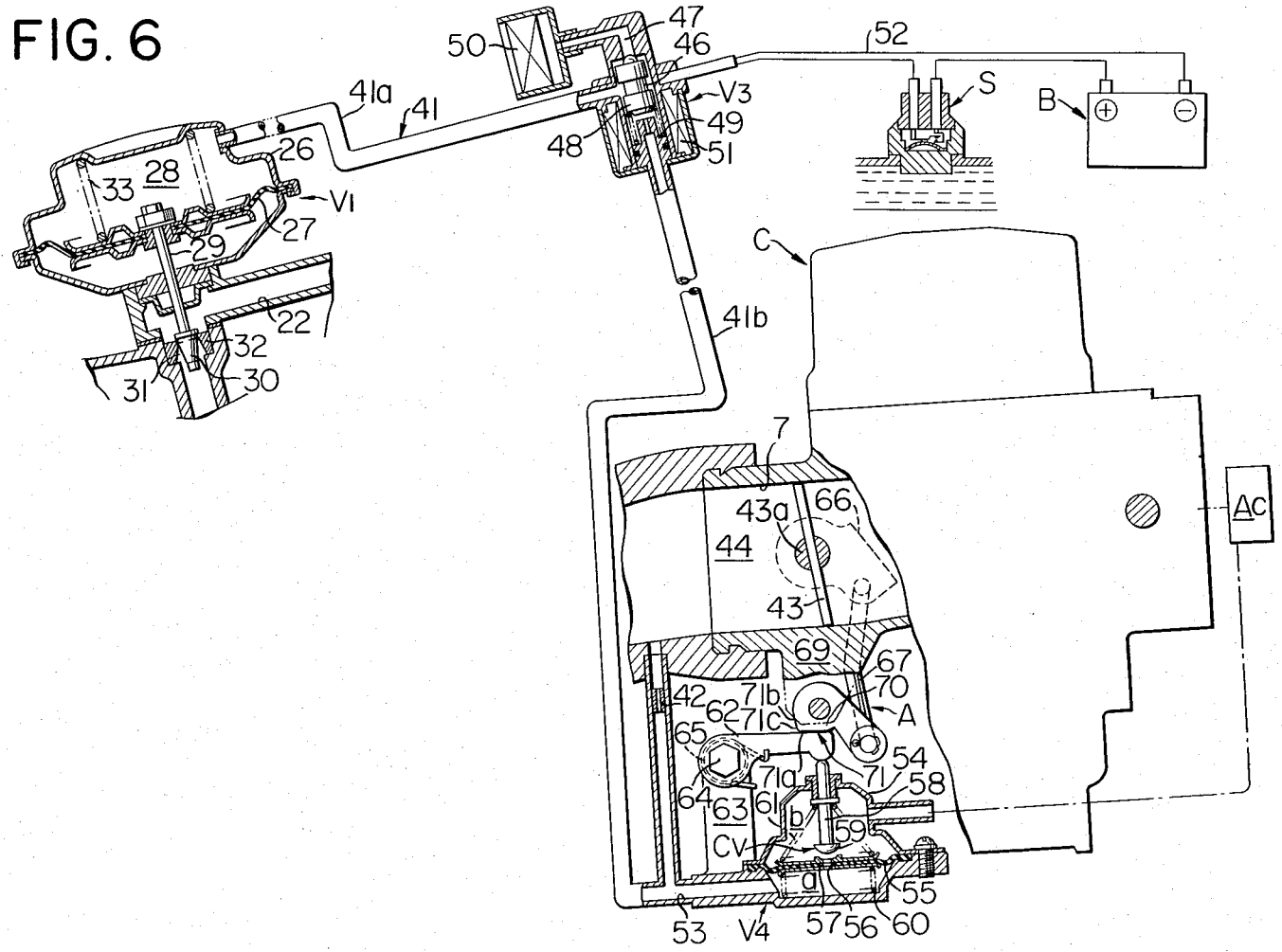
FIG. 6 is a view showing a portion of FIG. 3 when in an idle running operation after the internal combustion engine has been warmed up.

[2] Idle Running Mode after Warm-up of Engine (FIG. 6)

At an idle running mode after the engine E has been warmed up, the flow rate of the intake air is a little to make the scavenging operation insufficient, while leaving the burned gas residing in the combustion chamber 11, so that the combustion phenomena are generally unstable to have a low output power and a little emission of the $NO_x$. Therefore, the exhaust gas recirculation to the intake system is not effected. When that engine E is at its idle running state, the engine body 1 is already at its warmed-up state. As a result, the oil temperature exceeds the predetermined level to turn "OFF" the thermo-switch S and accordingly the electromagnetic change-over valve $V_3$ so that the valve body 48 is lifted by the elastic force of the valve spring 49 to block the leak passage 47 but to establish the communication of the vacuum supply passage 41. On the other hand, since the throttle valve 43 of the carburetor C is substantially fully closed, the cam member 70 is rotated clockwise through the drive stay 66 and the rod 67 to bring its first lower cam surface 71*a* into abutment contact with the control stay 62 so that this control stay 62 is slightly rocked upward by the elastic force of the return spring 65. As a result, the valve rod 58 of the vacuum control valve $V_4$ is lifted by the elastic force of the valve spring 61 thereby to increase the opening of the variable orifice Cv which is defined by the valve seat 57 and the valve body 59. As a result, the flow rate of the atmospheric air into the vacuum chamber a via that variable orifice Cv is increased to weaken the vacuum force in the vacuum chamber a, which is exerted upon the vacuum chamber 28 of the exhaust gas recirculation valve $V_1$ by way of the vacuum supply passage 41 thereby to maintain said valve $V_1$ at its closed state. As a result, in this case, the exhaust gas does not flow into the exhaust gas recirculation passage 22 so that no exhaust gas recirculation to the intake system is conducted.

Figure 7:
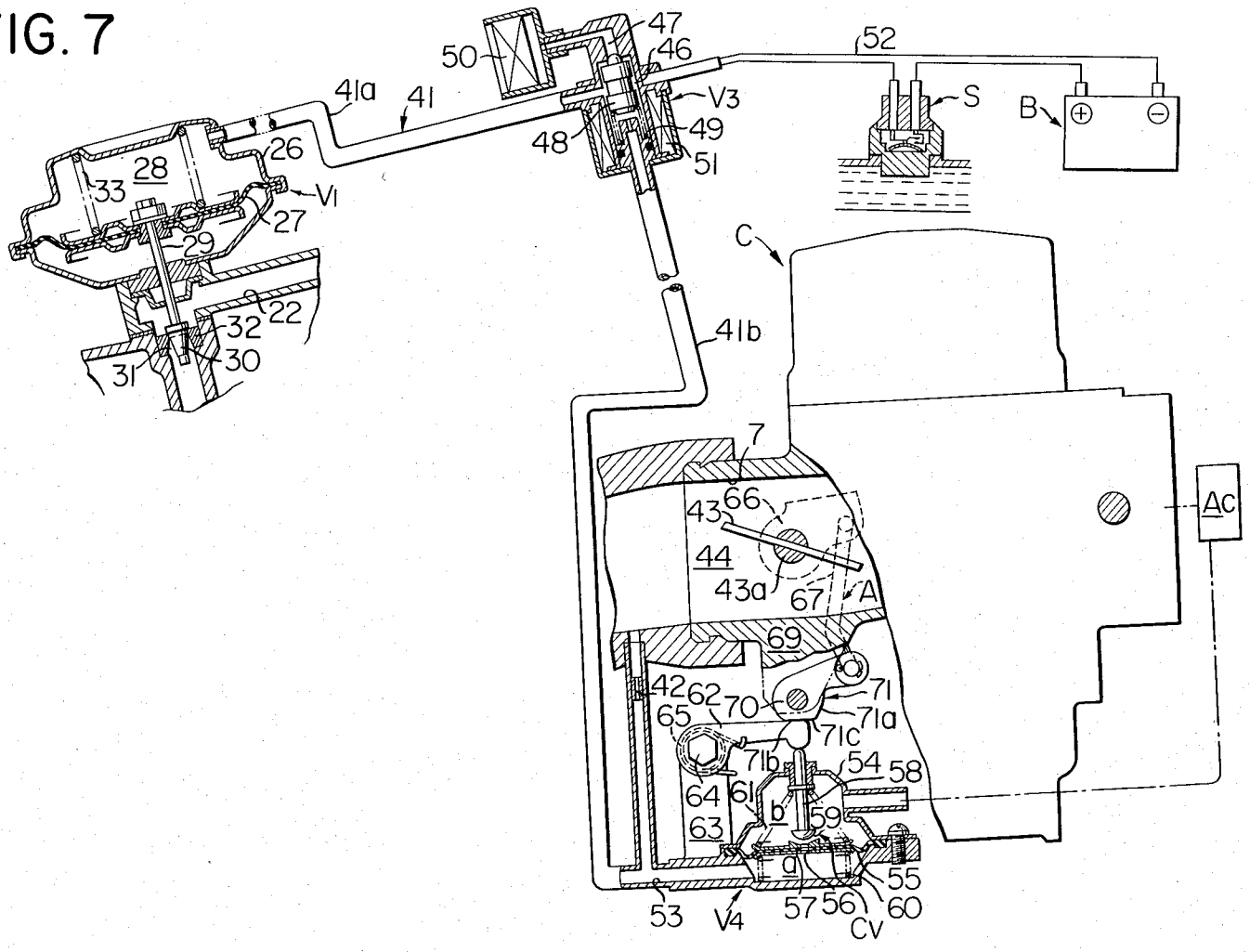
FIG. 7 is a view showing a portion of FIG. 3 when in a high-load running operation after the internal combustion engine has been warmed up.

[3] High-Load Running Mode of Engine (FIG. 7)

At a high-load running mode of the engine, the flow rate of the mixture to be sucked into the combustion chamber is increased so that the temperature of the exhaust gas resulting from the explosion and combustion of that mixture is accordingly elevated. This exhaust gas at the high temperature is recirculated into the intake system so that the parts constituting said intake system or the like can be little adversely affected by the hot exhaust gas. Moreover, since it is necessary to generate a high output power at the high-load running mode thereby to enhance the output characteristics of the engine, the exhaust gas recirculation to the intake system is not effected even at a high-output running mode of the engine E. In this case, as shown in FIG. 7, the throttle valve 43 of the carburetor C is substantially fully closed, and the rod 67 is pulled up through the drive stay 66 so that the cam member 70 is rotated counter-clockwise to bring its second lower cam surface 71*b* into abutment contact with the control stay 62. In this case, the valve rod 58 of the vacuum control valve $V_4$ is also lifted by the elastic force of the valve spring 61 thereby to augment the opening of the variable orifice Cv so that the exhaust gas recirculation valve $V_1$ is held at its closed position likewise the forementioned idle running mode. As a result, in the case of this high-output running mode, the exhaust gas does not flow into the exhaust gas recirculation passage 22 so that the exhaust gas recirculation to the intake system is not effected.

Figure 8:
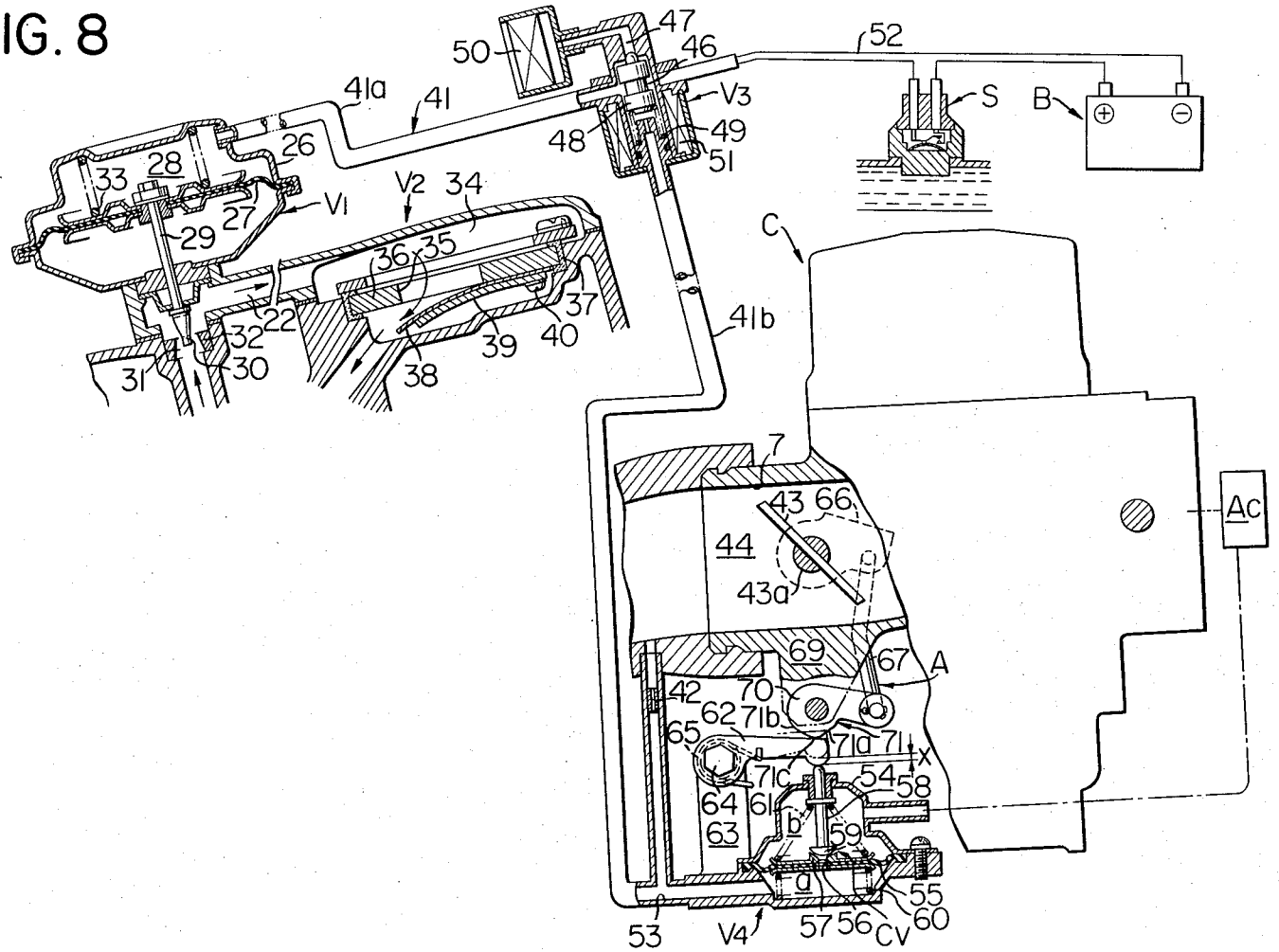
FIG. 8 is a view showing a portion of FIG. 3 when in an intermediate-load running operation after the warm-up.

[4] Medium-Load Running Mode of Engine (FIG. 8)

In the medium-load running range, in which the throttle valve 43 of the carburetor C has its opening larger than the substantially fully closed idling opening and smaller than the substantially fully opened high-load opening, the exhaust gas is recirculated into the intake system in response to the opening of that throttle valve, i.e., at a flow rate proportional to that of the intake air. These operations will be described more specifically in the following. At a state in which the throttle valve 43 has its medium-load opening, as shown in FIG. 8, the upper cam surface 71*c*, which is defined by the first and second lower cam surfaces 71*a* and 71*b*, is in contact with the control stay 62. Thus, that upper cam surface 71*c* imparts, within its area, the vertical displacement x to the control stay 62, i.e., the valve rod 58 in accordance with the change in the opening of the throttle valve 43. That displacement x is increased with the increase in the opening of the throttle valve 43. Now, when the opening of the throttle valve 43 in the medium-load range of the engine E is relatively small, the forementioned displacement x is also small so that the position of the diaphragm 55 balanced with that displacement x is accordingly elevated. As a result, the pushing force of the diaphragm spring 60, by which the diaphragm 55 is pushed up, is relatively weak. As a result, the pushing force of that diaphragm spring 60 is exceeded by the force of the intake vacuum to be exerted upon the inside of the vacuum chamber a. That intake vacuum force shifts the diaphragm 55 downward to increase the opening the variable orifice Cv. As a result, the vacuum force to be exerted upon the exhaust gas recirculation valve $V_1$ weakened so that the cone valve 30 of said valve $V_1$ has its lift reduced to have its effective area accordingly reduced. As a result, the flow rate of the exhaust gas to be fed into the intake port 5 from the exhaust port 6 by way of the exhaust pick-up port 20 and the exhaust gas recirculation valve $V_1$ is controlled to a lower value.

Next, if the opening of the throttle valve 43 in the medium-load running range is gradually increased, the rod 67 is pulled up so that the cam member 70 is slightly rotated counter-clockwise to increase the aforementioned displacement x. Then, the valve rod 58 is also slightly moved down to lower the position of the diaphgram balanced therewith so that the diaphragm spring 60 is compressed to strengthen the elastic force to push the diaphragm 55 upward. Moreover, that pushing force exceeds the vacuum force to be exerted upon the vacuum chamber a, i.e., the force for pushing down the diaphragm 55. As a result, the opening of the variable orifice Cv is reduced to decrease the flow rate of the atmospheric air into the vacuum chamber a so that the vacuum force to be exerted upon the vacuum chamber 28 of the exhaust gas recirculation valve $V_1$ is raised to increase the lift of the cone valve 30, whereby the effective area of the valve opening 31 of the exhaust gas recirculation valve $V_1$ is increased to augment the flow rate of the exhaust gas to be recirculated into the intake port 5. By setting the valve shape of the exhaust gas recirculation valve $V_1$, therefore, the exhaust gas can be recirculated at a rate proportional to the intake air flow rate into the intake port 5.

In the medium-load running range of the engine E, moreover, let the state be considered, at which the throttle valve 43 has such a predetermined opening as to have the vacuum force in the vacuum chamber a balanced with the spring force of the diaphragm spring 60 thereby to maintain the opening of the variable orifice Cv at a predetermined level so that the exhaust gas is recirculated at a rate proportional to the intake air flow rate into the intake port 5. At that particular state, if any disturbance is exerted to shift the diaphragm 55 downward, the opening of the variable orifice Cv is enlarged so that the flow rate of the atmospheric air into the vacuum chamber a is increased to weaken the vacuum force in said chamber a. As a result, that vacuum force is overcome by the elastic force of the diaphragm spring 60 so that the diaphragm 55 is returned to its initial position. Even with the disturbances, therefore, the diaphragm 55 is stably held at a predetermined position by the feedback action thus far described so that the vacuum force to be exerted upon the vacuum chamber 28 of the exhaust gas recirculation valve $V_1$ is always maintained at a constant level, so long as the opening of the throttle valve 43, ie., the flow rate of the intake air is invaried, whereby the opening of said valve $V_1$ is held at a constant level to recirculate a predetermined flow rate of the exhaust gas is recirculated into the intake port 5.

In the embodiment thus far described, the cone valve 30 of the aforementioned exhaust gas recirculation valve $V_1$ is so formed as to have a strength to break the combustion products such as soot deposited on the valve seat member 32. On the other hand, the vacuum control valve $V_4$ can have the area of its diaphragm 55 set to design the spring force of the valve spring 61 at a suitable strength so that the opening and closing operations of the throttle valve 43 is not dragged.

Generally speaking, the exhaust gas recirculation (EGR) valve is so shaped as to break the deposits such as the soot which sticks to or deposits upon the valve seat member thereof so that a strong operating force is required for operating and closing said valve. In this respect, since that exhaust gas recirculation valve is connected to the throttle valve of the carburetor, there arises a disadvantage that the throttling operation is dragged. According to the present invention, however, the vacuum control valve $V_4$, which can be controlled by a weak operating force, is made coactive through the interlocking mechanism A with the throttle valve 43 of the carburetor C so that the force of the vacuum to be fed to the vacuum chamber 28 of the exhaust gas recirculation (EGR) valve $V_1$ can be controlled by the operation of said valve $V_4$ thereby to open and close said valve $V_1$. As a result, the throttling operation is made so smooth and light that fatigue of the rider can be lightened.

On the other hand, the opening of the aforementioned throttle valve 43 controls the opening of the variable orifice Cv of the vacuum control valve $V_4$ through the interlocking mechanism A thereby to increase and decrease the flow rate of the atmospheric air which is to be introduced via the vacuum supply passage 41 into the vacuum chamber 28 of the exhaust gas recirculation valve $V_1$. As a result, the exhaust gas can be recirculated into the intake system at a flow rate which is precisely proportional to the opening of the throttle valve 43, i.e., the intake air flow rate. Thus, the intrinsic object of the exhaust gas recirculation (EGR) to minimize the emission of the $NO_x$ while preventing the deterioration of the drivability and minimizing the generation of the unburned noxious contents such as the HC or CO can be achieved without fail.

Even if the engine E is disturbed, moreover, the precise control of the vacuum control valve $V_4$ is maintained by the aforementioned feedback of said valve $V_4$. As a result, if the opening of the throttle valve 43 is constant, the vacuum force to be exerted upon the exhaust gas recirculation valve $V_1$ is held constant at all times so that the propotional relationship between the flow rate of the intake air and the flow rate of the exhaust gas to be fed to the intake system is not dispersed by the aforementioned disturbances.

Moreover, the intake and exhaust ports 5 and 6, which are formed in the cylinder head 1*a* of the engine body 1, are made to communicate with each other by way of the exhaust gas recirculation passage 22 which is formed in the head cover 23 crowning the cylinder head 1*a*. As a result, the passage for the exhaust gas recirculation is not exposed to the outside so that it can be protected from an outside obstacle. At the same time, the exhaust gas recirculation passage 22 does not occupy the space around the engine body 1 so that the attachment and maintenance of devices such as the spark plugs 16 are not troubled.

Furthermore, since the exhaust gas recirculation circuit is formed merely by crowning the cylinder head 1*a* with the head cover 23, not only the assembly is made remarkably xcellent but also the whole construction is simplified so that the exhaust gas recirculation system of the present invention can be provided at a low cost.

What is claimed is:

1. In an exhaust gas recirculation system for an internal combustion engine, comprising: an exhaust pick-up port communicating with an exhaust passage; an exhaust gas recirculation port communicating with an intake passage having therein a throttle valve; and an exhaust gas recirculation passage providing communication between said exhaust pick-up port and said exhaust gas recirculation port so that the exhaust gas in said exhaust passage may be partially recirculated into said intake passage by the intake pressure prevailing in said intake passage, the improvement comprising; a vacuum-operated type exhaust gas recirculation valve disposed midway of said exhaust gas recirculation passage for regulating and controlling the flow rate of the exhaust gas to flow in said exhaust gas recirculation passage; a vacuum supply passage opening to said intake passage downstream of said throttle valve for providing communication of a vacuum chamber of said exhaust gas recirculation valve with said intake passage; a vacuum control valve connected with said vacuum supply passage for controlling the vacuum force of intake air to flow in said vacuum supply passage, wherein said vacuum control valve includes a valve housing, a diaphragm partitioning the inside of said valve housing into a vacuum chamber communicating with said vacuum supply passage and an atmospheric chamber vented to the atmosphere, a valve seat formed on said diaphragm and formed with a valve opening for providing communication between said vacuum chamber and said atmospheric chamber, a valve body adapted to be brought into and out of contact with said valve seat and made coactive with said valve seat for forming a variable orifice, and a diaphragm spring for biasing said diaphragm so that said valve seat may approach said valve body; and an interlocking mechanism for interlocking said vacuum and said throttle valve, said interlocking mechanism having a control member disposed between said vacuum control valve and said throttle valve for providing positive control of the interlocking relation between those valves.

2. An exhaust gas recirculation system as set forth in claim 1, wherein said interlocking mechanism control member is coactive with said valve body and is responsive to the opening and closing operations of said throttle valve for moving said valve body up and down.

3. An exhaust gas recirculation system as set forth in any of the preceding claims 1 or 2, wherein said exhaust pick-up port and said exhaust gas recirculation port are formed in the cylinder head of an engine, and wherein said exhaust gas recirculation passage is formed in a head cover crowning said cylinder head.

* * * * *